US008162136B2

(12) United States Patent
McKenzie et al.

(10) Patent No.: US 8,162,136 B2
(45) Date of Patent: Apr. 24, 2012

(54) PACKAGE FOR DIFFERENT TOBACCO PRODUCTS

(75) Inventors: Aaron McKenzie, London (GB); Steve Dickason, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 12/602,967

(22) PCT Filed: Apr. 17, 2008

(86) PCT No.: PCT/EP2008/054679

§ 371 (c)(1), (2), (4) Date: Jun. 7, 2010

(87) PCT Pub. No.: WO2008/148603

PCT Pub. Date: Dec. 11, 2008

(65) Prior Publication Data

US 2010/0270184 A1 Oct. 28, 2010

(30) Foreign Application Priority Data

Jun. 4, 2007 (SE) ..... 0701384

(51) Int. Cl.
*A24F 15/00* (2006.01)
*B65D 85/10* (2006.01)

(52) U.S. Cl. ..... 206/242; 206/236; 206/256

(58) Field of Classification Search ..... 206/86, 206/236–241, 242–275
See application file for complete search history.

(56) References Cited

U.S. PATENT DOCUMENTS

| | | | | | |
|---|---|---|---|---|---|
| 2,100,298 | A | * | 11/1937 | Baxter | 206/236 |
| 2,284,171 | A | * | 5/1942 | Silberman | 206/274 |
| 3,064,799 | A | * | 11/1962 | Butler | 206/246 |
| 6,162,516 | A | * | 12/2000 | Derr | 206/264 |
| 2002/0020640 | A1 | | 2/2002 | Garcia | |

FOREIGN PATENT DOCUMENTS

| | | | |
|---|---|---|---|
| WO | WO0054613 | A | 9/2000 |
| WO | WO0147380 | A1 | 7/2001 |
| WO | WO03016166 | A1 | 2/2003 |

OTHER PUBLICATIONS

PCT International Search Report and Written Opinion mailed Jun. 26, 2008.
International Preliminary Report on Patentability mailed Jun. 15, 2009.

* cited by examiner

*Primary Examiner* — Bryon Gehman
(74) *Attorney, Agent, or Firm* — Chadbourne & Parke LLP

(57) ABSTRACT

A package comprises a first unit for a smokable tobacco product and a second unit for a smokeless tobacco product. In one embodiment of the package, the second unit is of a material suitable as a barrier material for moisture and/or aroma related to the smokeless tobacco product.

20 Claims, 3 Drawing Sheets

PACKAGE FOR DIFFERENT TOBACCO PRODUCTS

CLAIM FOR PRIORITY

This application is a National Stage Entry entitled to and hereby claims priority under 35 U.S.C. §§365 and 371 corresponding to PCT Application No. PCT/EP2008/054679, titled, "Package for Tobacco Products," filed Apr. 17, 2008, which in turn claims priority to Swedish Application Serial No. SE 0701384-0, filed Jun. 4, 2007, all of which are hereby incorporated by reference.

FIELD OF THE INVENTION

The present invention relates to a package for tobacco products and a method of producing a package for tobacco products.

BACKGROUND OF THE INVENTION

Packaging for general consumer goods is varied and diverse, and a wide variety of packages for tobacco products are known in the art. Tobacco products can be offered in conjunction with supplemental products intended for use with the tobacco products. For example, packages are known which incorporate cigarettes with matches or lighters, see FR 2,565,210 A1. Such a package can make carrying and use of the tobacco products simpler and less cumbersome. There are also packages which provide loose tobacco and rolling papers in a single container, see U.S. Pat. No. 5,927,488. Such packages can provide a single, convenient parcel with the necessary components for a consumer to make their own cigarettes.

In addition to combining two different products that are intended to be used together, packaging solutions exist where one component supports or facilitates storage of unused products, whereas another accommodates used or consumed product. For example, in the tobacco field packages are known which both store new cigarettes and function as ashtrays, see WO 2000/045654 A1 or U.S. Pat. No. 5,520,196 A. Smokeless tobacco users have dual-purpose packaging in the form of packages which hold a supply of fresh, unused material as well as a disposal area for used product, often in the lid portion. See, Registered Community Design No. 000359823-0001 or SE 527,350 C2. Such a configuration is particularly useful for wrapped smokeless tobacco products as the wrapping material may be slow to degrade, meaning throwing them to the ground can be as disfavoured as discarding cigarette butts in the same manner.

Furthermore, there are packages in the tobacco field which accommodate users' varying tastes. One example is packaging which incorporates two separate compartments, each holding a plurality of cigarettes having a first or second flavourant, respectively. See, for example U.S. Pat. No. 7,124,883.

For users whose tastes may vary, general multi-functional packages are provided. U.S. Pat. No. 2,100,298 A describes a fabric pouch subdivided into a plurality of compartments for storing, e.g., a pipe, loose tobacco, and matches; or toiletries, cigarettes, and a lighter.

Finally, some packages are available which specifically attempt to respond to tobacco product users who want to reduce their consumption of tobacco products or who want a non-tobacco product provided with their tobacco product. In such packages, a plurality of cigarettes and a plurality of non-tobacco products, optionally nicotine-containing, may be provided. See, for example, GB 2,412,835A.

Despite these advances in packaging solutions there remains a need to provide packaging options for consumers which offer a mix of products while maintaining product quality.

SUMMARY OF THE PRESENT INVENTION

It is therefore an object of the present invention to provide a package which incorporates a smokable tobacco product and a smokeless tobacco product.

According to the invention a first unit of the package may contain smokable tobacco product and a second unit may contain a smokeless tobacco product.

With the purpose of providing a storage possibility for the smokeless tobacco product with a good storage environment and where this product will not affect any other products stored in the inventive package it is proposed that at least the second unit may be of a material suitable as a barrier material for moisture and/or aroma related to the smokeless tobacco product. In order to provide a good storage environment for the smokable tobacco product where this product will not affect other products in the inventive package it is also proposed that at least the first unit may be of a material suitable as a barrier material for the smokable tobacco product.

According to the invention, the first unit provides a discrete space for smokable tobacco products. These smokable products can be wrapped, e.g. with metallised paper wrappers, or the first unit itself can serve as a wrapper. The second unit provides a discrete space for smokeless tobacco products. These smokeless products can be wrapped or the second unit itself can serve as a wrapper. When so provided, the respective smokable and smokeless products can be protected both from environmental factors and from components of the other articles provided in their proximity.

In order to provide a possibility to take care of used tobacco products it is proposed that the package comprises at least one disposal unit for used products, for instance, it is proposed that the second unit comprises one product unit for smokeless tobacco products and one disposal unit for used smokeless products.

In order to make the smokeless tobacco products accessible to a user with a maintained good storage environment for the smokeless tobacco product it is proposed that the second unit comprises a base portion and a lid portion, and that the lid portion is resealably removable from the base portion.

An inventive package can be realised in different ways and one embodiment teaches that the package comprises an outer casing enclosing the first and second units. This outer casing could be selected from the group consisting of a flip top box, a soft pack, and a flexible film.

The second unit could be selected from the group consisting of a flip-top box, a blister-type container, a resealable zipper-type bag, and a container having an opening with a barrier or film resealably located over the opening.

The first unit can be selected from the group consisting of a flip top box, a soft pack, a blister-type container, and a resealable zipper-type bag.

The second unit can be arranged with the first unit in different ways. Examples of possible embodiments are that the second unit is sealingly, removably, replaceably, magnetically or hingedly attached to an outer side of a surface of the first unit. It is also possible that the second unit is sealingly, removably, replaceably, magnetically or hingedly attached to an inner side of a surface of the first unit.

The exemplifying embodiments described above relate to an inventive package with at least two units, a first unit for storage of a smokable tobacco product and a second unit for the storage of a smokeless tobacco product. However, it should be understood that the inventive idea can also be realised through a second unit for storage of a smokeless tobacco product that is adapted to connect with a first unit for storage of smokable products. That is the inventive product is the second unit by itself, which second unit is adapted to connect to separate first unit.

Such an inventive second unit can be sealingly, removably, replaceably, magnetically or hingedly attached to a surface of the first unit.

With the purpose of providing a storage possibility for the smokeless tobacco product with a good storage environment and where this product will not affect any other products in any first unit whereto the second unit is attached, it is proposed that the second unit may be of a material suitable as a barrier material for moisture and/or aroma related to the smokeless tobacco.

In order to provide a possibility to take care of used tobacco products it is proposed that the second unit comprises at least one product unit for smokeless tobacco products and a disposal unit for used products, and second unit comprises a base portion and a lid portion, and in order to make the smokeless tobacco products accessible to a user with a maintained good storage environment for the smokeless tobacco product, it is proposed that that the lid portion may be resealably removeable from the base portion.

The second unit can be attached to the first unit in a plurality of ways. One exemplifying embodiment of an inventive second unit is where the second unit is adapted to fit within the first unit, and can thus be adapted to fit within different first units, such as a flip top box or a soft pack.

The second unit may also be adapted to fit within an outer casing selected from the group consisting of a flip top box, a soft pack, and a flexible film.

The second unit itself can be selected from the group consisting of a flip-top box, a blister-type container, a resealable zipper-type bag, and a container having an opening with a barrier or film resealably located over the opening.

The second unit may be a refill package, that is, a unit that is reused and refilled many times.

The present invention also relates to a method of making an inventive package, the method comprising the steps of:

providing a first unit comprising a charge of a smokable tobacco product;

providing a second unit comprising a charge of a smokeless tobacco product; and assembling the package so as to join the first unit and the second unit.

The present invention also relates to the method of making an inventive package, the method comprising the steps of:

providing a first unit adapted to hold a smokable tobacco product;

providing a second unit adapted to hold a smokeless tobacco product; and assembling the package so as to join the first unit and the second unit.

It is proposed that the latter method further comprises the steps of:

filling the first unit with a charge of a smokable tobacco product; and filling the second unit with a charge of a smokeless tobacco product.

Advantages of an inventive package, an inventive second unit or an inventive method include the benefit that the invention enables the packaging of both smokable and smokeless moist tobacco products in one and the same package. This can be provided without any detrimental effect on the tobacco products and with packages that are easily pocketed and handled by a user.

As used herein, tobacco products are separated into two major classes, smokable tobacco products and smokeless tobacco products. "Smokable tobacco products" includes all tobacco products which are intended for consumption when burned or heated (pyrolysis). They include cigarettes, cigarillos and cigars. "Smokeless moist tobacco products" refers to all tobacco products which are intended for oral or nasal administration without any burning or heating. They can be loose or portioned. Examples include chewing tobacco and Swedish-style snus. Moisture levels vary depending on the specific product, but a characteristic of this class of goods is that their relative moisture or water activity level exceeds that of smokable tobacco products. For example, some types of Swedish-style snus have moisture levels of 20-50%.

As used herein, "tobacco" includes any part, e.g., leaves, flowers, stems, of any member of the genus *Nicotiana* and reconstituted materials thereof. It includes derivatives such as specific compounds found in natural tobacco, e.g., nicotine, whether extracted or synthesized, as well as structural derivatives such as the fibrous portion of a tobacco leaf. It further includes tobacco substitutes which comprise individual chemicals and/or complex chemical entities which, when appropriately prepared, physically resemble natural tobacco.

The term "flip top box" refers to any package generally along the lines of the well-known hinged lid paperboard box provided for cigarettes. Flip top boxes can have various configurations such as edges/corners which are substantially square, substantially non-square, bevelled, rounded, or a combination thereof. Lid size and placement can vary.

The term "soft pack" refers to any package generally along the lines of the well-known flexible film and paper-wrapped charge of smoking articles. Such packages vary, e.g., with the location and type of tear line which allows a user to remove a wall or a portion of a wall for access.

"Blister-type container" refers to a general class of packaging which provides a formed tray-like recess which accommodates a product and a sealing layer which may comprise a second tray-like recess or a semi-flexible layer such as one formed of paper, plastic, or metallized foil. The recess is conventionally made of vacuum-formed plastic but could be any suitable material, including metals, papers, and combination products.

BRIEF DESCRIPTION OF THE DRAWINGS

In order that the subject invention may be easily understood and readily carried into effect, reference will now be made, by way of example, to the accompanying diagrammatic drawings, in which.

DETAILED DESCRIPTION

For tobacco product consumers who choose to use a variety of different tobacco products, or where external factors such as restrictions on smoking influence a choice of product it is desirable to provide the consumer with a single packaging option.

Due to the differing nature of smokable and smokeless tobacco products, the packaging that will accommodate both ideally will be configured in such a way so as to provide at least as good storage conditions as a user finds in single-product packaging. For example, smokeless tobacco can be provided in a moist format, e.g. 50% moisture. As such, a moisture barrier is ideally incorporated in the packaging to retain the high level of moisture in the product as product performance can decrease rapidly as the product dries out.

Smokable tobacco products can also be sensitive to environmental factors. Increasingly, these products incorporate catalysts and filtration aids such as additives in wrapping paper or filters, which components provide improved product performance. However, certain of the components are sensitive to moisture or odours in their immediate environment, such that keeping the product dry and relatively self-contained is preferred. Furthermore, where flavourants or aromas are used in conjunction with either smokable or smokeless products, it may be desired to package the goods in such a way that volatile flavouring elements do not evaporate, and so that they do not pass on their flavour or aroma to other articles stored in their vicinity.

Recent advances in resealable openings, such as zipper-style closures and adhesive films configured to resealably close a container opening, can offer advantages when used in conjunction with the invention. Furthermore, the overall dimensions of the package are ideally configured to have a suitable size and volume to contain a standard amount of product, but remain easily handled and pocketed. With existing packaging solutions users are forced to compromise product performance by mixing different products in one container, or compromise convenience and simplicity by carrying a plurality of separate and distinct container on their person at any given time. Thus the invention provides benefits for the products and the portability of the overall package.

Properties and advantages of the present invention will now be described with reference to FIG. 1 which schematically shows a package 1 comprising a first unit 11 for a smokable tobacco product and a second unit 12 for a smokeless tobacco product.

At least the second unit 12 is of a material suitable as a barrier material for moisture and/or aroma related to the smokeless tobacco product, and at least the first unit 11 is of a material suitable as a barrier material for the smokable tobacco product.

Figure 2:
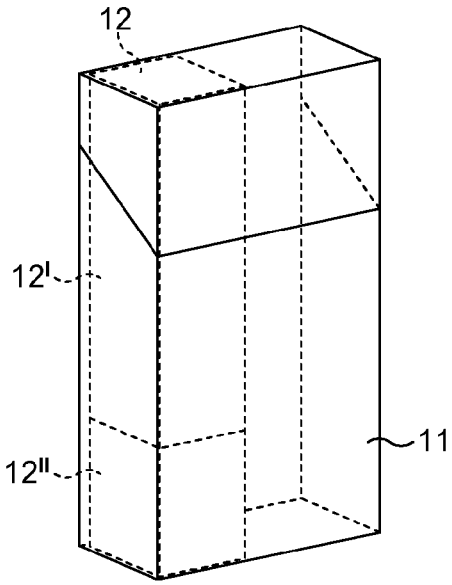
FIG. 2 shows a second unit with a product unit and a disposal unit.

It is proposed that either or both of the first and second unit 11, 12 can be sub-divided e.g. by internal walls into a plurality of compartments. FIG. 2 shows an embodiment where the inventive package 1 comprises at least one disposal unit 12" for used products.

It is possible to have a disposal unit for used smokeless product or used smokable product. As previously noted combination cigarette and ashtray products are known as are combination unused and used snus containers. The present invention teaches that the second unit 12 can comprise one product unit 12' for smokeless tobacco products and one disposal unit 12" for used smokeless products. It is also possible that an inventive package, in addition to this, could comprise an ashtray or other suitable disposal means for used smokable tobacco products.

Figure 3:
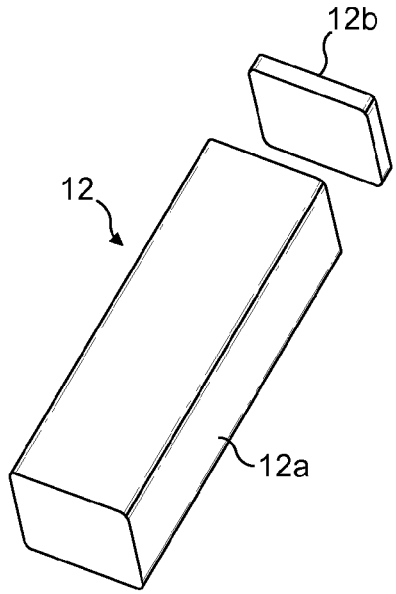
FIG. 3 shows a second unit with a base portion and a lid portion.
Figure 4:
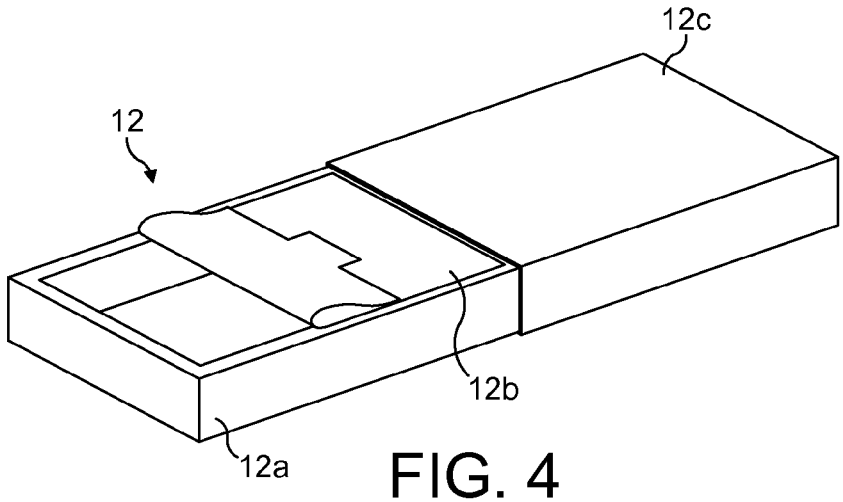
FIG. 4 shows an alternative embodiment of a second unit with a base portion and a lid portion.

FIGS. 3 and 4 each show a second unit 12 which comprises a base portion 12*a* and a lid portion 12*b*, where the lid portion 12*b* is resealably removeable from the base portion 12*a*. Opening(s) in a second unit could take any convenient shape but preferably will allow finger access to the product. In some embodiments it is preferred that the products are easily removable. In some embodiments the products are removed by shaking the second unit, which may be provided with means that facilitates dispersal of a single product unit per shake. The FIG. 4 embodiment further comprises a sliding outer portion 12*c* which forms an additional protective barrier over the lid portion 12*b*.

Figure 5:
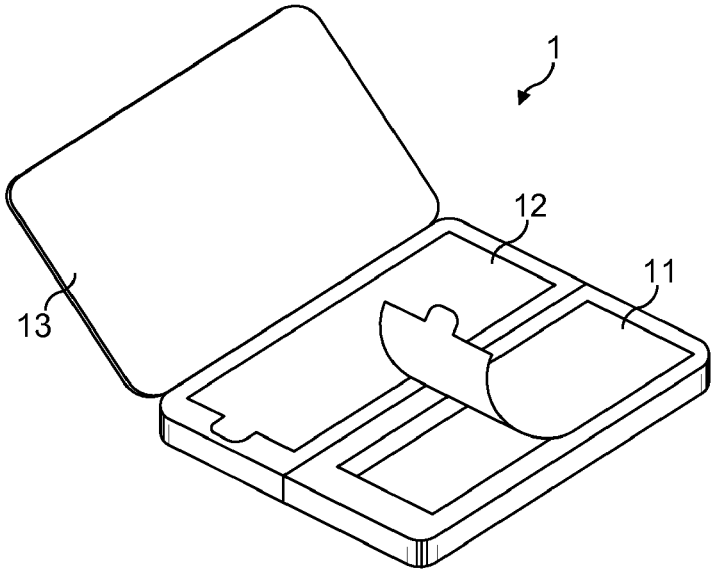
FIG. 5 shows a package with an outer casing holding a first and a second unit.
Figure 6:
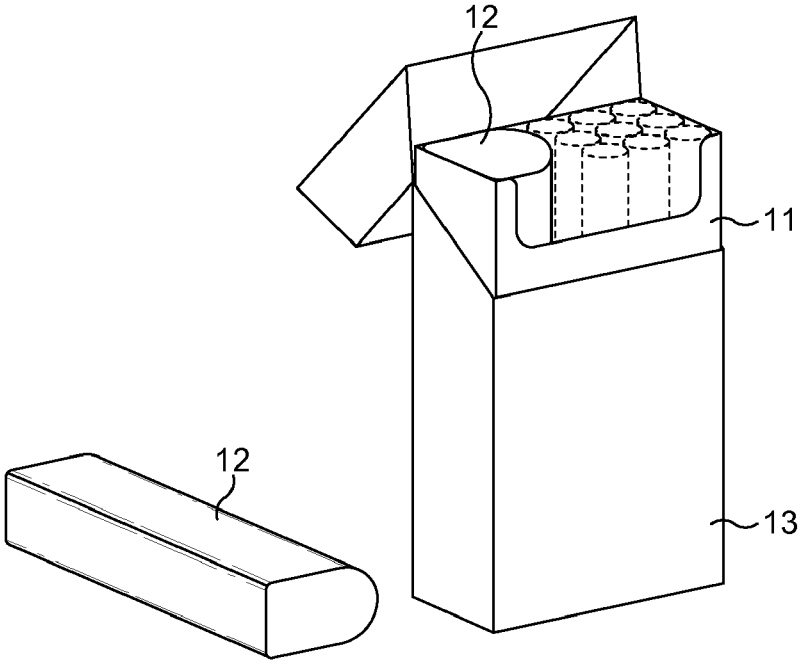
FIG. 6 shows a second unit within a first unit.

As will be evident to a skilled person, the present invention can be realised through different embodiments. One proposed embodiment illustrated in FIG. 5 teaches that the package 1 comprises an outer casing 13 enclosing the first and second units 11, 12. An outer casing could be selected from the group consisting of a flip top box, a soft pack, a flexible film such as shrink-wrap or heat-sealed polyfilms typically used as the outer wrapper for cigarette packages. In the embodiment of FIG. 5 the outer casing 13 is a piece of formed metal which is configured to fit around the blister-type packaging which comprises the first and second units 11, 12. One possible embodiment shown in FIG. 6 is then that the first unit 11 is a flip-top box and the second unit 12 is inside the first unit 11, where the outer casing 13 is an outer plastic wrap which could be clear, opaque, printed, or have any other surface treatment desired.

The second unit 12 can for instance be selected from the group consisting of a flip-top box, a blister-type container, a resealable zipper-type bag, and a container having an opening with a barrier or film resealably located over the opening, and the first unit 11 can for instance be selected from the group consisting of a flip top box, a soft pack, a blister-type container, and a resealable zipper-type bag. For instance, if the smokable product is loose tobacco for roll-your-own users, a zipper-type bag might be preferred.

Figure 1A:
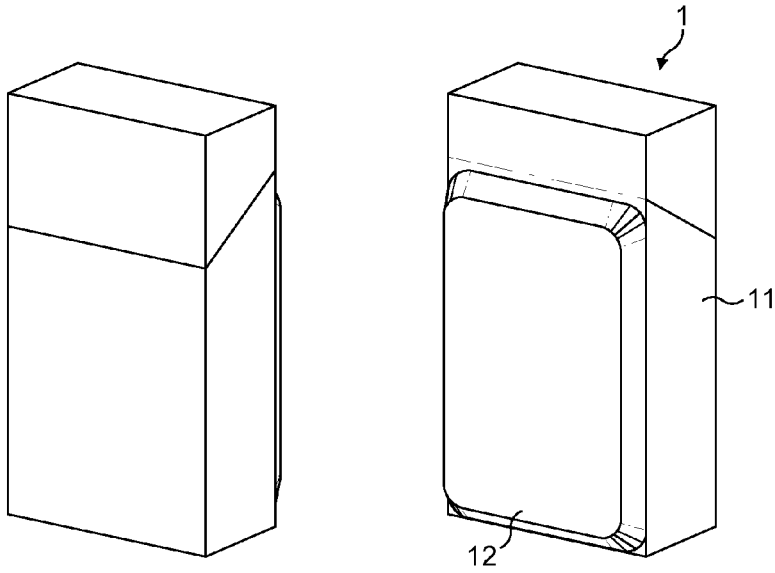
FIGS. 1*a* and 1*b* show an embodiment with a second unit attached to an outside surface of a first unit in an adjacent and distanced position, respectively.
Figure 1B:
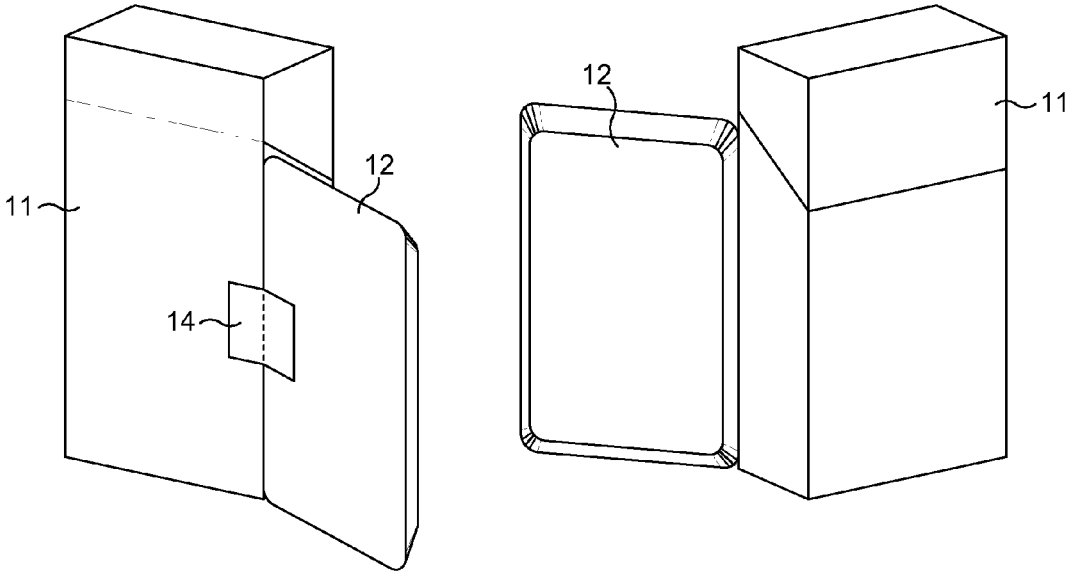

It is proposed that the second unit 12 is sealingly, removably, replaceably, magnetically or hingedly attached to an outer side of a surface of the first unit 11, as illustrated in FIG. 1, where FIG. 1*b* shows the attachment 14. The second unit 12 may alternatively be sealingly, removably, replaceably, magnetically or hingedly attached to an inner side of a surface of the first unit 11, as illustrated in FIG. 6. Any suitable attachment means beyond the specific examples given is within the scope of the invention.

The present invention also relates to a second unit 12 for storage of a smokeless tobacco product, as shown in FIG. 3. The second unit 12 is adapted to connect with a first unit 11 for storage of a smokable product.

The inventive second unit 12 can be attached to the surface or inside of a first unit by any means, such as sealingly, removably, replaceably, magnetically or hingedly attached to the first unit, FIG. 1 showing an embodiment where the second unit 12 is hingedly attached to the first unit 11.

It is proposed that the second unit 12 is of a material suitable as a barrier material for moisture and/or aroma related to the smokeless tobacco.

FIG. 2 shows a proposed embodiment where the second unit 12 comprises at least one product unit 12' for unused smokeless tobacco products and a disposal unit 12" for used products.

FIGS. 3 and 4 show two different embodiments where the second unit 12 comprises a base portion 12*a* and a lid portion 12*b*, where the lid portion 12*b* is resealably removeable from the base portion 12*a*.

FIG. 1 shows that the second unit 12 can be attached to the surface of the first unit 11, an alternative way to attach the second unit 12 to the first unit 11 is shown in FIG. 5 where they are provided side-by-side, or it is also possible to adapt the second unit 12 to fit within the first unit 11 as shown in FIG. 6.

The second unit 12 can be adapted to be attached to a first unit 11 which could be selected from the group consisting of a flip top box, a soft pack, a blister-type container, and a resealable zipper-type bag.

The second unit 12 can also be adapted to fit within an outer casing 13 which according to certain embodiments might be selected from the group consisting of a flip top box, a soft pack, and a flexible film, where a first unit 11 for a smokable tobacco product also can be fitted within the outer casing 13, FIG. 6 showing an embodiment where the second unit 12 is fitted within the first unit 11, which in turn is fitted within an outer casing 13 made out of a flexible film.

The second unit 12 can be any suitable container, such as one selected from the group consisting of a flip-top box, a blister-type container, a resealable zipper-type bag, and a container having an opening with a barrier or film resealably located over the opening.

The inventive second unit can for instance be a refill package.

The present invention also relates to a method of making a package, comprising the steps of:

providing a first unit comprising a charge of a smokable tobacco product;

providing a second unit comprising a charge of a smokeless tobacco product; and assembling the package so as to join the first unit and the second unit.

An alternative method of making an inventive package is a method comprising the steps of:

providing a first unit adapted to hold a smokable tobacco product;

providing a second unit adapted to hold a smokeless tobacco product; and assembling the package so as to join the first unit and the second unit.

The latter proposed method can also comprise the steps of:

filling said first unit with a charge of a smokable tobacco product; and filling said second unit with a charge of a smokeless tobacco product.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A package, comprising:

a first unit containing a smokable tobacco product; and a second unit forming an attachment to a side of a surface of said first unit, said attachment being one of sealing, removable, replaceable, magnetic and hinged attachment, said second unit containing a smokeless tobacco product, wherein at least said second unit comprises a barrier material to at least one of moisture and aroma related to said smokeless tobacco product.

2. The package according to claim 1, wherein at least said first unit comprises a barrier material for said smokable tobacco product.

3. The package according to claim 1, wherein said package comprises at least one disposal unit for used products.

4. The package according to claim 3, wherein said second unit comprises one product unit for smokeless tobacco products and one disposal unit for used smokeless products.

5. The package according to claim 1, wherein said second unit comprises a base portion and a lid portion, and that said lid portion is resealably removeable from said base portion.

6. The package according to claim 1, wherein said package comprises an outer casing enclosing said first and second units.

7. The package according to claim 6, wherein said outer casing is selected from a group consisting of a flip top box, a soft pack, and a flexible film.

8. The package according to claim 6, wherein said second unit is selected from a group consisting of a flip-top box, a blister container, a resealable zipper bag, and a container having an opening with a barrier or film resealably located over the opening.

9. The package according to claim 1, wherein said first unit is selected from a group consisting of a flip top box, a soft pack, a blister container, and a resealable zipper bag.

10. The package according to claim 1, wherein said second unit is sealingly, removably, replaceably, magnetically or hingedly attached to an inner side of a surface of said first unit.

11. A smokeless tobacco unit containing a smokeless tobacco product, wherein said smokeless tobacco unit comprises an attachment structure that serves one of sealingly, removably, replaceably, magnetically and hingedly connect with a surface of a unit containing a smokable product; and wherein said smokeless tobacco unit comprises a barrier material providing a barrier to at least one of moisture and aroma related to said smokeless tobacco product.

12. The smokeless tobacco unit according to claim 11, wherein said smokeless tobacco unit further comprises a disposal unit for used products.

13. The smokeless tobacco unit according to claim 11, wherein said smokeless tobacco unit comprises a base portion and a lid portion, and that said lid portion is resealably removeable from said base portion.

14. The smokeless tobacco unit according to claim 11, wherein said smokeless tobacco unit is adapted to fit within said unit containing a smokable product.

15. The smokeless tobacco unit according to claim 11, wherein the attachment is configured to connect with a unit containing a smokable tobacco product selectable from a group consisting of a flip top box, a soft pack, a blister container, and a resealable zipper bag.

16. The smokeless tobacco unit according to claim 11, wherein said smokable tobacco unit is adapted to fit within an outer casing selected from a group consisting of a flip top box, a soft pack, and a flexible film.

17. The smokeless tobacco unit according to claim 11, wherein said smokeless tobacco unit is selected from a group consisting of a flip-top box, a blister container, a resealable zipper bag, and a container having an opening with a barrier or film resealably located over the opening.

18. The smokeless tobacco unit according to claim 11, wherein said smokeless tobacco unit is a refill package.

19. A method of making a package, comprising:

providing a first unit comprising a charge of a smokable tobacco product;

providing a second unit comprising a charge of a smokeless tobacco product, the second unit formed of at least one material acting as a barrier to at least one of moisture and aroma related to said smokeless tobacco product; and assembling the package so as to join the first unit and the second unit via one of sealing, removable, replaceable, magnetic and hinged attachment.

20. The method according to claim 19, wherein said first unit is selected from a group consisting of a flip top box, a soft pack, a blister container, and a resealable zipper bag.

* * * * *